US008132431B2

(12) United States Patent
Brandl

(10) Patent No.: US 8,132,431 B2
(45) Date of Patent: Mar. 13, 2012

(54) KNITTING MACHINE

(75) Inventor: Klaus Benno Brandl, Hainburg (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 0 days.

(21) Appl. No.: 12/870,238

(22) Filed: Aug. 27, 2010

(65) Prior Publication Data

US 2011/0067455 A1 Mar. 24, 2011

(30) Foreign Application Priority Data

Sep. 18, 2009 (DE) ..... 10 2009 042 213

(51) Int. Cl.
*D04B 27/24* (2006.01)

(52) U.S. Cl. ..... 66/207

(58) Field of Classification Search ..... 66/207, 66/208, 206, 204
See application file for complete search history.

(56) References Cited

U.S. PATENT DOCUMENTS

| | | | | |
|---|---|---|---|---|
| 2,106,434 | A * | 1/1938 | Morton et al. | 66/207 |
| 2,155,146 | A * | 4/1939 | Hannay et al. | 66/207 |
| 2,562,034 | A * | 7/1951 | Hannay | 66/204 |
| 2,737,034 | A | 3/1956 | Noe | |
| 2,775,881 | A * | 1/1957 | Held | 66/207 |
| 2,782,617 | A * | 2/1957 | Noe | 66/207 |
| 2,997,867 | A | 8/1961 | Engelhard | |
| 3,247,686 | A * | 4/1966 | Lanthier | 66/207 |
| 3,303,670 | A | 2/1967 | Bassist | |
| 4,086,792 | A * | 5/1978 | Gangi | 66/207 |
| 4,414,826 | A * | 11/1983 | Mista et al. | 66/207 |
| 6,182,476 | B1 * | 2/2001 | Frassi et al. | 66/207 |
| 7,320,233 | B2 | 2/2008 | Lonati | |
| 7,757,519 | B2 | 7/2010 | Lonati | |

FOREIGN PATENT DOCUMENTS

| | | |
|---|---|---|
| DE | 41 27 344 | 2/1993 |
| EP | 1498531 | 1/2005 |
| GB | 789771 | 1/1958 |
| JP | SHO37-9789 | 1/1959 |
| JP | HEI7-507606 | 8/1995 |
| JP | 2007-239173 | 9/2007 |
| JP | 2009-71660 | 12/2009 |
| WO | WO 85/01528 | 4/1985 |
| WO | 94/23106 | 10/1994 |

OTHER PUBLICATIONS

Search report from E.P.O. dated Feb. 4, 2011 that issued with respect to counterpart European Patent Application No. 10007441.8 (along with partial English-language translation).
Japanese Office Action dated Sep. 13, 2011 conducted in counterpart Japanese Application (with translation).

* cited by examiner

*Primary Examiner* — Larry Worrell, Jr.
(74) *Attorney, Agent, or Firm* — Greenblum & Bernstein, P.L.C.

(57) ABSTRACT

Knitting machine, method of guiding a guide bar and guide bar drive for a knitting machine. Knitting machine includes a shogging drive, a swing-through drive, and at least one guide bar, which is moveable by the shogging drive in a shogging direction and by the swing-through drive perpendicular to the shogging direction. Further, a slide surface pairing has two slide surfaces oriented perpendicularly to the shogging direction, and the shogging drive acts on the guide bar via the slide surface pairing.

19 Claims, 1 Drawing Sheet

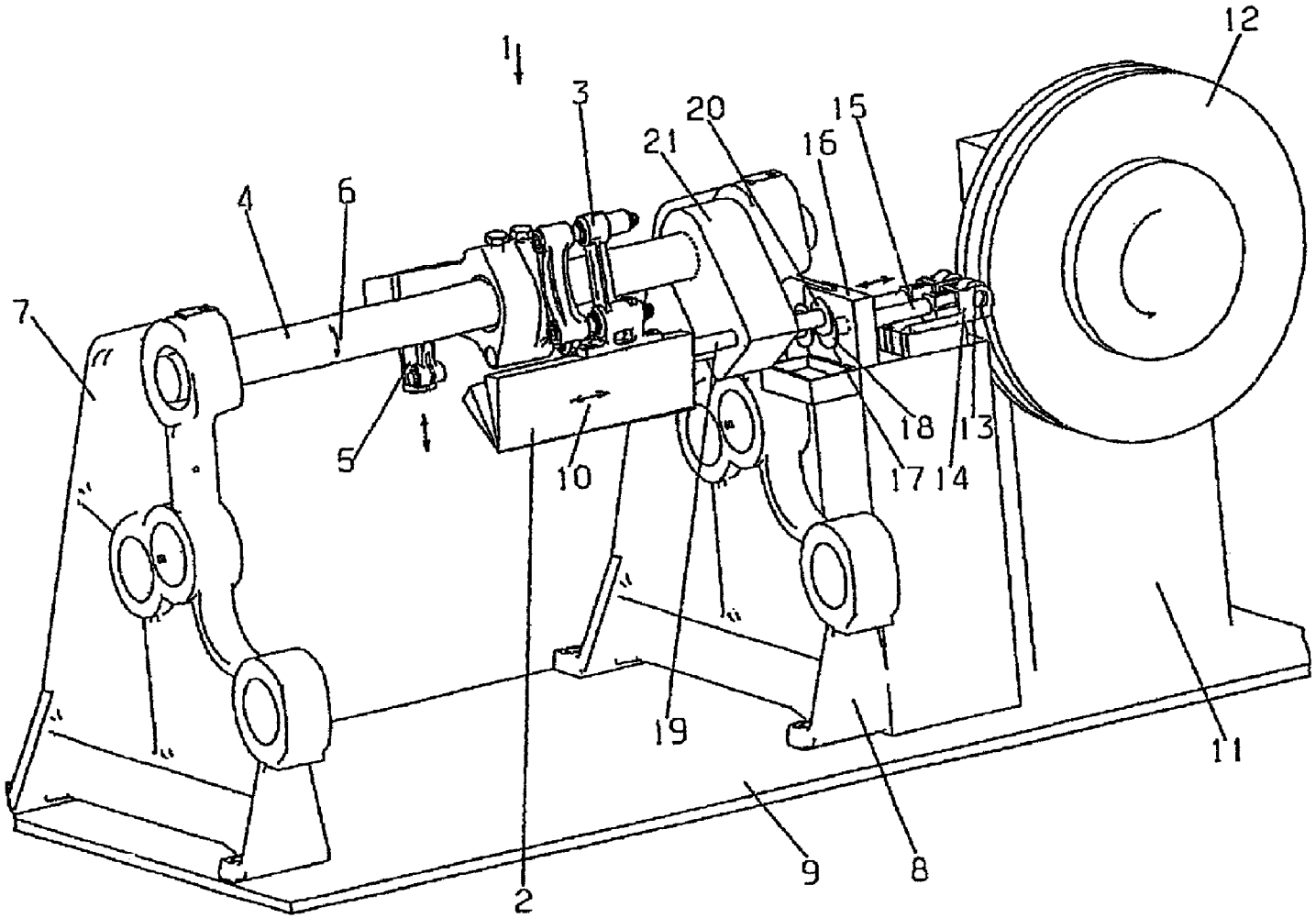
12
11
13
14
15
16
17
18
8
9
20
21
19
3
10
2
1
5
6
4
7

KNITTING MACHINE

CROSS-REFERENCE TO RELATED APPLICATIONS

The present application claims priority under 35 U.S.C. §119(a) of German Patent Application No. 10 2009 042 213.7 filed Sep. 18, 2009, the disclosure of which is expressly incorporated by reference herein in its entirety.

BACKGROUND OF THE INVENTION

1. Field of the Invention

The invention relates to a knitting machine with at least one guide bar, which is moveable by a shogging drive in a shogging direction and by a swing-through drive perpendicular to the shogging direction.

2. Discussion of Background Information

In the production of a knitted article in a knitting machine, guides must be guided around needles in order to produce a loop formation. The guides are thereby attached to the guide bar. The sequence of movements of the guide bar is therefore controlled such that in a loop formation the guide bar is moved once back and once forth in a shogging direction. Thus, the shogging direction is the direction that corresponds to the longitudinal extension of the guide bar, i.e., the direction in which all of the guides of the guide bar are arranged one behind the other. The guide bar is additionally moved perpendicular to the shogging direction between the forth (forward) movement and the back movement. A movement perpendicular to the shogging direction is likewise necessary between the back movement and the forth movement of the following loop formation operation.

The movement perpendicular to the shogging direction is often caused in that the guide bar is attached to a suspension shaft, which is rotated back and forth via a machine transmission. The shogging movement is controlled by a shogging drive, which moves the guide bar back and forth. The shogging drive is responsible among other things for the patterning, i.e., how large the lift of the guide bar is in each case in a loop formation operation is controlled with the aid of the shogging drive.

A known method for controlling the shogging movement of the guide bar in a knitting machine is to use a pattern disk against which a contact roller bears. The contact roller is connected to a shogging slider. A ball pin is provided at the other end of the shogging slider, which ball pin is in engagement with a push rod, which in turn is in engagement with a ball pin on the guide bar. The push rod has ball sockets at both of its ends. The ball pins are thus hinge-mounted in the ball sockets. Thus, it is possible to also drive the guide bar through the pattern disk when it performs a swing-through motion perpendicular to the shogging direction. Through the two ball pin/ball socket bearings, the push rod compensates for the different distances that result between the front and the rear swing-through position on the one hand and the center position on the other hand.

In order to compensate for these changes caused by the swing-through movement of the effective length of the push rod, it has been proposed in DE 41 27 344 A1 to overlap a ground function with a compensation function. This compensation function must be taken into account when producing the pattern disk.

One disadvantage of this approach is still that alternately lateral forces act on the bar. This causes a negative alternating stress on the guide bar guidance and also generates frictional heat and wear in the ball connections. Another disadvantage is that the ball connections can be produced with the necessary precision only with relatively high expenditure. Even with a very precise production, temperature changes, which result, e.g., from the considerable frictional heat in the ball connections, cause division inaccuracies that lead to problems.

SUMMARY OF THE INVENTION

Embodiments of the invention render possible the most precise possible control of the shogging movement of the guide bar.

According to embodiments, a knitting machine of the type mentioned at the outset includes the shogging drive that acts on the guide bar via a slide surface pairing with two slide surfaces that are directed perpendicular to the shogging direction.

The two slide surfaces of the slide surface pairing can thus be displaced relative to one another perpendicular to the shogging direction in that they slide against one another. Nevertheless, drive forces can be transferred to the guide bar in the shogging direction via the interacting slide surfaces of the slide surface pairing. This does not result in any change in the active length of transfer elements between the shogging drive and the guide bar. Thus, the guide bar can be controlled very precisely by the shogging drive without further auxiliary measures. Moreover, lateral forces on the guide bar and the shogging drive are kept low.

Preferably, the shogging drive has a transfer element guided in the shogging direction, and the transfer element supports one slide surface of the slide surface pairing. This transfer element can be guided in the shogging direction. A lateral load of this transfer element is virtually ruled out. At most, slight lateral forces act on the transfer element, which are produced by the friction in the slide surface pairing. These friction forces, however, are relatively low, so that they do not have any negative effects on the transfer element or the bearing thereof.

It is also advantageous if the transfer element is embodied or formed as an actuator rod. The actuator rod can be guided over a certain length in the shogging direction so that it can easily absorb the relatively low lateral forces, if they occur at all. Thus, a relatively precise bearing of the actuator rod can be achieved, which can also operate over a longer period without noticeable wear.

Preferably, the guide bar has a bar element having a slide surface of the slide surface pairing. The bar element then forms the counterpart as it were to the transfer element. It is thus possible to provide a targeted point of application for the application of drive forces on the bar.

Preferably, the bar element runs through a guide element, which is connected in a rotatably fixed manner to a suspension shaft on which the guide bar is also supported. A simple way of generating the swing-through movement, i.e., the movement perpendicular to the shogging direction, is to suspend the guide bar on a suspension shaft and to produce the swing-through movement by rotating the suspension shaft back and forth over a small angular range. If the bar element is now provided with a support, i.e., the guide element that also performs this rotary movement of the suspension shaft, it can be ensured that the lateral forces on the bar element likewise remain low. Lateral forces on the guide bar are also kept low thereby.

Preferably, the bar element is moveable with respect to the guide element in the shogging direction and is guided through the guide element in the shogging direction. The guide element is therefore attached to the suspension shaft not only in a rotatably fixed manner, but also in a stationary manner in the shogging direction. The bar element that transfers the movement from the shogging drive to the guide bar can be moved through the guide element. Thus, the masses that have to be moved in the shogging movement are kept small. The shogging drive can be sized accordingly, i.e., it does not need to move the guide element with it in the shogging direction.

Preferably, at least one slide surface is embodied or formed on a slide plate. A slide plate of this type provides an enlarged area, that is an area that is larger than the diameter of the transfer element and/or the bar element. The transfer element and the bar element can be provided with a thinner cross section, which helps to keep the size of the moved masses small. However, there is no appreciable restriction in the size of the swing-through movement, because a sufficient force for moving the guide bar can always be transferred with the aid of the slide plates.

Preferably, at least one slide surface has a friction-reducing coating. Plastics, e.g., are possible as friction-reducing coatings. If both slide surfaces are provided with a friction-reducing coating, these coatings can be coordinated with one another such that the smallest possible friction coefficient is achieved.

Alternatively, or additionally thereto, it can be provided that at least one slide surface has a lubricant supply. Thus, for example, a lubricant such as grease can be sprayed or pressed into the slide surface pairing. This also helps to keep the friction between the two slide surfaces low so that during the swing-through movement of the guide bar friction forces are produced, which are virtually insignificant. However, the reduction in friction is not a problem in the shogging direction because only compressive forces are transferred here.

Preferably, the shogging drive has a pattern disk or pattern chain and a retraction device. The retraction device can be embodied or formed, e.g., as a spring. The pattern disk or the pattern chain transfers compressive forces in one direction onto the guide bar, e.g., via a feeler roll. The retraction device transfers forces in the other direction onto the guide bar. Thus, it is ensured that the two slide surfaces of the slide surface pairing always bear against one another. A precise control of the shogging movement is thus possible in each phase of the shogging movement.

Embodiments of the invention are directed to a knitting machine that includes a shogging drive, a swing-through drive, and at least one guide bar, which is moveable by the shogging drive in a shogging direction and by the swing-through drive perpendicular to the shogging direction. Further, a slide surface pairing has two slide surfaces oriented perpendicularly to the shogging direction, and the shogging drive acts on the guide bar via the slide surface pairing.

In accordance with embodiments, the shogging drive can include a transfer element guided in the shogging direction, which supports one of the slide surfaces of the slide surface pairing. The transfer element may be formed as an actuator rod.

According to other embodiments, at least one guide bar may include a bar element that includes one of the slide surfaces of the slide surface pairing. The knitting machine can also include a guide element and a suspension shaft on which the guide bar is supported. The bar element can run through the guide element, which may be connected to the suspension shaft in a rotatably fixed manner. The bar element may be moveable with respect to the guide element in the shogging direction and can be guided through the guide element in the shogging direction.

According to other embodiments of the invention, a slide plate can include at least one of the slide surfaces.

In accordance with still other embodiments of the instant invention, at least one of the slide surfaces can have a friction-reducing coating.

According to still further features of the embodiments, at least one of the slide surfaces can have a lubricant supply.

Further, the shogging drive may include one of a pattern disk or a pattern chain and a retraction device.

Embodiments of the invention are directed to a method of guiding a guide bar of a knitting machine. The method includes mounting a guide bar on a stationary shaft for lateral movement in a shogging direction parallel to the stationary shaft and for movement generally in a direction perpendicular to the lateral movement, forming a slide surface pairing comprising two abutting slide surfaces, and moving the slide surface pairing in the shogging direction via an actuating rod acted on by a shogging drive. In this manner, the slide surface pairing pushes the guide bar in the shogging direction via a bar element.

According to further features, the method can include guiding the bar element through a guide element. The method can also include fixedly mounting the guide element on the stationary shaft.

In accordance with other features of the embodiments, the shogging drive may include one of a pattern disk or a pattern chain.

According to other features, the method can include moving the guide bar in a direction opposite the shogging direction.

In accordance with still further features of the embodiments of the present invention, the method can include moving the guide bar generally perpendicularly to the lateral direction. When moving the guide bar generally perpendicularly to the lateral direction, the abutting slide surfaces may slide relative to each other.

According to still other features of the embodiments, the method can include lubricating the abutting slide surfaces.

In accordance with still yet other embodiments of the present invention, the abutting slide surfaces may have sliding face diameters greater than a diameter of either of the actuation rod or the bar element.

Embodiments of invention are directed to a guide bar drive for a knitting machine that includes a shogging drive, an actuator rod having a first sliding face arranged on one end and acted on by the shogging drive on the other end, and a bar element having a second sliding face arranged on one end and an opposite end of the bar element being structure and arranged to act on a guide bar. The first and second sliding faces are arranged to abut each other to form a slide surface pairing.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of non-limiting example of an exemplary embodiment of the present invention, and wherein:

The FIGURE diagrammatically illustrates a section of a knitting machine.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A knitting machine 1 has at least one guide bar 2, which is attached in a rotatably fixed manner to a suspension shaft 4 via a guide bar guidance 3. Suspension shaft 4 is rotated back and forth in the direction of a double arrow 6 via a main machine shaft (not shown in greater detail) and a push rod attached thereto, which acts on a lever arm 5. Suspension shaft 4 is thereby hinge-mounted in two side walls 7 and 8 of a machine frame 9.

A needle bar likewise necessary for a loop formation for a knitted article is not shown here for reasons of clarity.

Guide bar 2 is also moved back and forth in shogging direction 10 for loop formation. Shogging direction 10 thereby corresponds to the longitudinal direction of guide bar 2.

In order to cause this movement, a shogging drive 11 is provided, which is arranged on the side of side wall 8 facing away from guide bar 2. In the present case, shogging drive 11 has a pattern disk 12, which is likewise driven by the main machine shaft, so that the movement of pattern disk 12 is synchronized with the movement of lever arm 5.

A feeler roll 13 bears against the pattern disk 12. The feeler roll is arranged at one end of a shogging slider 14, which acts with its other end on a transfer element embodied as a push rod 15. Push rod 15 is supported in a guide device 16 and guided in guide device 16 in shogging direction 10, i.e., in guide device 16 it can perform exclusively movements in shogging direction 10. However, guide device 16 is able to absorb smaller lateral forces.

A slide plate 17 is arranged on an end of push rod 15 facing towards the guide bar 2, and slide plate 17 has a slide surface 18 on its front face. Slide surface 18 is directed or oriented perpendicular to the shogging direction 10. Slide plate 17 has a diameter that is greater than the diameter of push rod 15.

Guide bar 2 is connected to a bar element 19, which is embodied or formed as a push rod and has a further slide plate 20 on its end facing away from guide bar 2. The slide plate has a greater diameter compared to the push rod. Slide plate 20 also has a slide surface (not visible) on the side facing towards shogging drive 11, which bears against slide surface 18 of slide plate 17 to form a slide surface pairing.

Bar element 19 is inserted through a guide element 21 and is guided in shogging direction 10 by guide element 21. Guide element 21 is connected to suspension shaft 4 in a rotatably fixed manner. Accordingly, bar element 19 performs the same movements perpendicular to shogging direction 10 as guide bar 2. Guide element 21 absorbs lateral forces on bar element 19 and keeps these lateral forces away from guide bar 2.

Two slide plates 17 and 20 bear against one another under a certain pressure during operation. A retraction device (not shown in further detail), e.g., a tension spring that draws guide bar 2 in the direction towards shogging drive 11, or a compression spring that presses guide bar 2 in the direction towards shogging drive 11, ensures that the two slide plates 17 and 20, bear against one another permanently.

Compressive forces are therefore permanently transferred from shogging drive 11 onto guide bar 2 or vice versa during operation. Push rod 15 as well as bar element 19 thereby maintain their respective alignment in shogging direction 10. Through the friction between the two slide plates 17 and 20, a slight friction occurs, which however leads to only low lateral forces on bar element 19 or push rod 15. These low lateral forces are absorbed by guide device 16 and guide element 21, so that neither shogging drive 11 nor guide bar 2 is acted on with lateral forces, i.e., forces transverse to shogging direction 10. Guide bar 2 thus follows the shogging parameters of shogging drive 11 exactly in shogging direction 10. Since the two slide plates 17 and 20 slide against one another, the swing-through movement of guide bar 2 can be compensated with respect to stationary shogging drive 11.

Slide plates 17 and 20 can be coated on their slide surfaces 18 with a friction-reducing material in order to keep the friction low during operation. Alternatively, or additionally, a lubricant supply can also be used in order to continuously feed a lubricant, e.g., grease, into the contact region between the two slide plates 17 and 20. This measure also serves to keep the friction low between the two slide plates 17 and 20.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A knitting machine comprising:

a shogging drive;

a swing-through drive;

at least one guide bar, which is moveable by the shogging drive in a shogging direction and by the swing-through drive perpendicular to the shogging direction;

a first slide plate being connected to the at least one guide bar and having a slide facing;

a second slide plate having a slide face; and a transfer element which is coupled to the shogging drive and coupled to the second side plate, wherein the slide surfaces are arranged to form a slide surface pairing in which the two slide surfaces are oriented perpendicularly to the shogging direction, and wherein the shogging drive acts on the guide bar via the slide surface pairing.

2. The knitting machine in accordance with claim 1, wherein the transfer element is formed as an actuator rod.

3. The knitting machine in accordance with claim 1, further comprising a guide element and a suspension shaft on which the guide bar is supported, wherein the bar element runs through the guide element, which is connected to the suspension shaft in a rotatably fixed manner.

4. The knitting machine in accordance with claim 3, wherein the bar element is moveable with respect to the guide element in the shogging direction and is guided through the guide element in the shogging direction.

5. The knitting machine in accordance with claim 1, further comprising a slide plate comprising at least one of the slide surfaces.

6. A knitting machine comprising:

a swing-through drive;

at least one guide bar, which is moveable by the shogging drive in a shogging direction and by the swing-through drive perpendicular to the shogging direction; and a slide surface pairing having two slide surfaces oriented perpendicularly to the shogging direction, wherein the shogging drive acts on the guide bar via the slide surface pairing, wherein at least one of the slide surfaces has at least one of a friction-reducing coating and a lubricant supply.

7. The knitting machine in accordance with claim 1, wherein the shogging drive comprises one of a pattern disk or a pattern chain and a retraction device.

8. A method of guiding a guide bar of a knitting machine, comprising:

mounting a guide bar on a stationary shaft for lateral movement in a shogging direction parallel to the stationary shaft and for movement generally in a direction perpendicular to the lateral movement;

wherein the guide bar is connected to at least one bar element and the at least one bar element is coupled to a first a slide plate having a first slide surface, and a transfer element coupled to a second slide plate that is connected to a slide surface;

forming a slide surface pairing by arranging the first and second slide surfaces to abut each other; and moving the slide surface pairing in the shogging direction via the transfer element being acted on by a shogging drive, whereby the slide surface pairing pushes the guide bar in the shogging direction via the bar element.

9. The method in accordance with claim 8, further comprising guiding the bar element through a guide element.

10. The method in accordance with claim 9, further comprising fixedly mounting the guide element on the stationary shaft.

11. The method in accordance with claim 8, wherein the shogging drive comprises one of a pattern disk or a pattern chain.

12. The method in accordance with claim 8, further comprising moving the guide bar in a direction opposite the shogging direction.

13. The method in accordance with claim 8, further comprising moving the guide bar generally perpendicularly to the lateral direction.

14. The method in accordance with claim 13, wherein, when moving the guide bar generally perpendicularly to the lateral direction, the abutting slide surfaces slide relative to each other.

15. The method in accordance with claim 8, further comprising lubricating the abutting slide surfaces.

16. The method in accordance with claim 8, wherein the abutting slide surfaces have sliding face diameters greater than diameters of either of the actuation rod or the bar element.

17. A guide bar drive for a knitting machine, comprising:

a shogging drive;

an actuator rod having a slide plate with a first sliding face arranged on one end and acted on by the shogging drive on the other end; and a bar element having a slide plate with a second sliding face arranged on one end and an opposite end of the bar element being structured and arranged to act on a guide bar, wherein the slide plates comprising the first and second sliding faces are arranged to abut each other to form a slide surface pairing.

18. The method in accordance with claim 8, wherein the transfer element comprises an actuating rod.

19. The knitting machine in accordance with claim 1, wherein the slide surfaces of the slide surface pairing have slide surface diameters greater than a diameter either of the transfer element or the guide bar element.

* * * * *